US005370091A

United States Patent [19]

Swagerty et al.

[11] Patent Number: 5,370,091

[45] Date of Patent: Dec. 6, 1994

[54] BATTERYLESS STARTING AND IGNITION SYSTEM AND METHOD FOR INTERNAL COMBUSTION ENGINE

[76] Inventors: Bruce A. Swagerty, 314 Fillmore, Topeka, Kans. 66606; Cynthia L. Diehl, 1537 NE 39th St., Topeka, Kans. 66617

[21] Appl. No.: 50,838

[22] Filed: Apr. 21, 1993

[51] Int. Cl.[5] ..... F02N 11/14

[52] U.S. Cl. ..... 123/179.1; 290/36 R

[58] Field of Search ..... 123/179.1, 179.19, 595, 123/179.28; 417/364; 290/36 R, 37 R

[56] References Cited

U.S. PATENT DOCUMENTS

| | | | |
|---|---|---|---|
| 4,831,277 | 5/1989 | Christopher | 290/1 A |
| 5,041,776 | 8/1991 | Shirata et al. | 320/1 |
| 5,146,095 | 9/1992 | Tsuchiya et al. | 290/38 R |
| 5,155,373 | 10/1992 | Tsuchiya et al. | 290/38 R |
| 5,155,374 | 10/1992 | Shirata et al. | 290/38 R |
| 5,157,267 | 10/1992 | Shirata et al. | 290/38 R |

FOREIGN PATENT DOCUMENTS

| | | | |
|---|---|---|---|
| 0376667 | 7/1989 | European Pat. Off. . | |
| 2028012 | 12/1971 | Germany | 123/179.1 |
| 1495489 | 7/1989 | U.S.S.R. . | |
| 1665064 | 7/1991 | U.S.S.R. . | |

*Primary Examiner*—Andrew M. Dolinar

*Attorney, Agent, or Firm*—Litman, McMahon & Brown

[57] ABSTRACT

A batteryless starting and ignition system for a conventional automotive internal combustion engine includes a battery replacement circuit which simulates the effect of an operational automotive lead-acid battery in the engine electrical circuit while the engine is running. A jumper cable connector is wired across the replacement circuit to facilitate jump starting of the engine. The system is particularly useful to replace automotive batteries in irrigation systems in which automotive engines are adapted to drive irrigation pumps continuously for periods up to six months.

13 Claims, 1 Drawing Sheet

BATTERYLESS STARTING AND IGNITION SYSTEM AND METHOD FOR INTERNAL COMBUSTION ENGINE

BACKGROUND OF THE INVENTION

1. Field of the Invention

This invention is directed to a batteryless starting and ignition system for an internal combustion engine, and more particularly to such a system including a battery replacement circuit which is connected in place of a conventional automotive lead-acid battery. A jumper cable connector is wired across the replacement circuit and a compatible jumper cable connector is provided to jump start the engine from an external power source.

2. Description of the Related Art

In portions of the western United States, massive agricultural irrigation systems often use standard automobile internal combustion engines to drive irrigation pumps. It is estimated that there are upwards of 100,000 of these automobile engines pumping water through irrigation systems in Western Kansas and Eastern Colorado alone. Generally the engines have been converted to run on natural gas, which is distributed to the engines via gas pipelines often paralleling the irrigation systems.

A typical operating cycle for these engines includes starting them up in the spring months and leaving them running continuously until the growing season is over in September or October. Thus, the engines are often in continuous operation for six months or more.

Although such engines are usually started only once or twice per year, it has been customary to provide a dedicated automotive lead-acid battery for each engine, with the batteries generally hauled out to the engines in the spring and removed in the winter. The batteries generally just sit beside or beneath the engines and are constantly exposed to the weather. This constant exposure to the elements, plus the fact that the batteries are continuously charged for months at a time, tends to severely shorten the effective battery life, with batteries often having to be replaced each season, or, at best, after two seasons. Furthermore, the irrigation systems are usually in remote locations and battery theft and/or vandalism is a constant problem. Of course, if a battery is removed or destroyed while an engine is running, the engine will shut off. The net effect is that each automotive battery is generally used for, at best, eight or so engine starts before it is discarded or stolen.

It would be desirable to simply omit the automobile batteries from irrigation system engines and just jump start the engines each spring from a service vehicle. To accomplish this, since all such engines include an electrical system with a conventional alternator and voltage regulator, the lead-acid battery would need to be replaced with a circuit which "fools" the voltage regulator and alternator by simulating the closed circuit effect of a lead-acid battery.

SUMMARY OF THE INVENTION

In the practice of the present invention, a typical lead-acid battery for an internal combustion automotive engine, such as those used to drive irrigation pumps in large agricultural irrigation systems, is replaced by a circuit which simulates the closed circuit effect of the missing lead-acid battery to the voltage regulator and alternator. A female jumper cable connector physically forms a part of the circuit such that the engine can be easily jump started by a service vehicle. Once the engine is started, the jumper cable can be removed and the engine will continue to run. The invention is particularly useful in irrigation systems where such engines are placed in remote locations and typically run continuously for a period of several months each growing season.

OBJECTS AND ADVANTAGES OF THE INVENTION

The principle objects and advantages of the present invention include: to provide an improved batteryless ignition and starter system for internal combustion engines; to provide such a system with a circuit which replaces a conventional automotive lead-acid battery and simulates the electrical effects of the missing lead-acid battery to a conventional voltage regulator and alternator; to provide such a system in which the replacement circuit includes a jumper cable connector which allows the engine to be easily started by a service vehicle; to provide such a system in which the associated engine will continue to run after the jumper cable is removed; to provide such a system which is simple and economical to produce, yet very durable and reliable; and to provide such a starter system which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
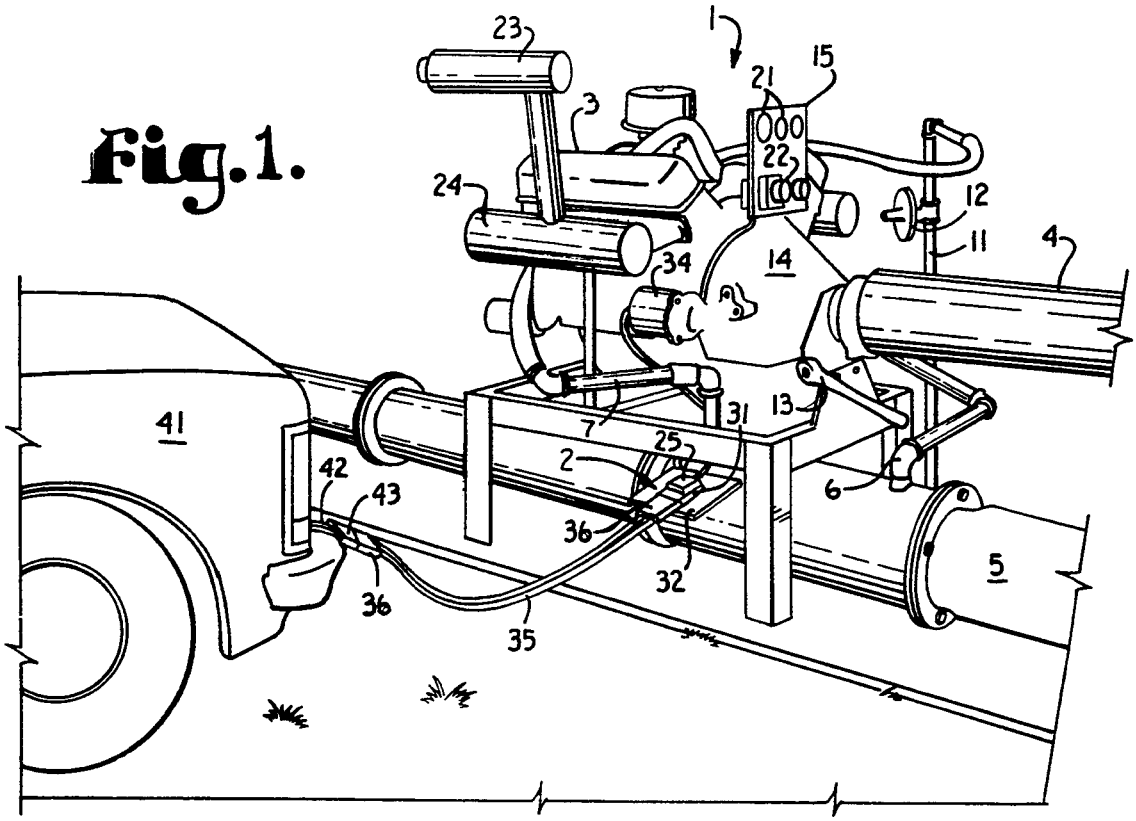
FIG. 1 is a perspective view of an automotive engine connected to drive an irrigation pump, with the engine equipped with a battery replacement circuit and with a service vehicle connected to the replacement circuit via a jumper cable.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail the reference numeral 1 in FIG. 1 generally designates an engine driven irrigation pumping station equipped with a battery replacement circuit 2 instead of a conventional automotive lead-acid battery. In FIG. 1, a conventional automotive internal combustion engine 3 is connected to drive an irrigation pump (not shown) via a drive shaft 4. The irrigation pump pushes water through an irrigation pipeline 5 and the engine 3 is cooled by water pulled from the pipeline 5 via an intake 6. The cooling water is returned to the pipeline via a return 7.

As is typical in such irrigation systems, the engine 3 has been modified to run on natural gas supplied through a pipe network or remote tanks. The natural gas for the engine 3 is supplied through a pipe 11 and a regulator 12. A hand operated clutch 13 is adapted to connect or disconnect the drive shaft 4 from a conventional automotive transmission 14. A gauge and control panel 15 includes a number of monitoring gauges 21 and starter control 22. Elevated exhaust systems 23 and manifolds 24 are provided to disperse engine exhaust.

BATTERY REPLACEMENT CIRCUIT

The battery replacement circuit 2 includes a housing 25, to which is attached a female Jumper cable connector 31. In FIG. 1, the circuit 2 is shown mounted on a support plate 32, which can be grounded to the pipeline 5. A positive lead 33 runs from the circuit 2 to an engine starter 34. A jumper cable 35, which preferably incorporates matching male connectors 36 at each end, is shown plugged into the female connector 31. A service vehicle 41 includes a jumper cable pigtail 42 which incorporates an additional female connector 43.

Figure 2:
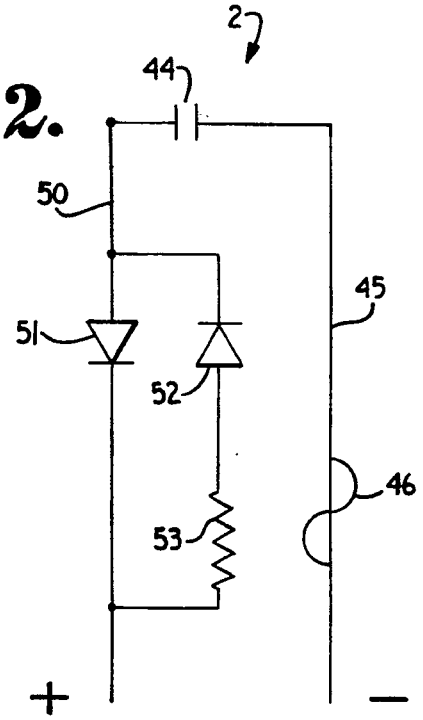
FIG. 2 is a circuit schematic diagram illustrating the battery replacement circuit.

The circuit 2, which is illustrated in more detail in FIG. 2, includes a capacitor 44 connected in series on one side to a ground lead 45 including a safety fuse 46. The capacitor 44 is series connected on the other side to a positive lead 50 including a circuit with a pair of parallel opposed diodes 51 and 52, with the diode 52 connected in series with a resistor 53. The positive lead 50 and the ground lead 45 are directly connected to respective sides of the female connector 31, as well as to the starter 34 and ground, respectively, of the engine 3.

OPERATION

During the initial start-up of the irrigation system in the spring, service vehicles such as the truck 41 make the rounds of the irrigations pumping stations 1, and plug the cable 35 into the electrical system of the truck 41 and into the female connector 31 on the circuit 2. The starter control 22 is then pushed, engaging the starter 34 of the engine 3 with the truck battery. Once the engine 3 is started and running smoothly, the clutch lever 13 is thrown and the engine 3 starts driving the drive shaft 4, and thus driving the connected pump. The jumper cable 35 is then unplugged from the connector 31, leaving the circuit 2 connected with the conventional alternator and voltage regulator circuits of the engine 3.

The voltage across the capacitor 44 will settle at approximately 12–14 volts, and the resistance 53 simulates the typical impedance of a connected lead-acid battery, thus "fooling" the voltage regulator into assuming that a fully charged lead-acid battery is in the circuit. In one preferred embodiment of the invention, the capacitor 44 is 1000 μFarads, the resistor 53 is 1K Ohm, the diodes 51 and 52 are each 3 amp capacity and the fuse 46 is rated at ¾ amp. Using these values for circuit components, the circuit 2 has been experimentally found to perform flawlessly in place of a typical automotive lead-acid battery continuously for many hours.

The advantages of using the inventive battery replacement circuit 2, particularly in irrigation applications, such as the one described above, are manifold. All of the following undesirable traits of the conventional, lead-acid battery based systems are avoided, i.e. the high initial and ongoing costs of the batteries themselves, the labor costs of installing and removing them each season, the deterioration of batteries and cables from repeated battery installation and removal, the shortened battery life, the possibility of theft, and the lead-acid battery storage costs and hazards. By contrast, the use of the inventive system involves a low, one-time start-up cost, no chemical hazard or storage problems, no or extremely low maintenance and long useful life.

It is to be understood that while certain forms of the present invention have been illustrated and described herein, it is not to be limited to the specific forms or arrangement of parts described and shown.

What is claimed and desired to be secured by Letters Patent is as follows:

1. A batteryless starting and ignition system for a conventional automotive-type internal combustion engine adapted to drive an irrigation pumping station, said engine including an electrical system with an electric starter, alternator and voltage regulator, said system comprising:

(a) battery replacement circuit which replaces and simulates the closed circuit effects of an automotive battery in said electrical system, said battery replacement circuit comprising a capacitor, a resistance element placed in series with said capacitor via a first diode of a first polarity, and a second diode placed in parallel with said resistance element and said first diode, said second diode having a polarity opposite from said first polarity;

(b) means for starting said engine via a removable external electrical power supply, said means for starting comprising a first jumper cable connector, said connector being placed in parallel across said battery replacement circuit, and a start switch for selectively connecting said first cable connector across the engine starter; whereby (c) said engine will run continuously after said external power supply is removed.

2. A system as in claim 1, and further comprising:

(a) a jumper cable with second and third connectors at opposite ends, at least one of which removably mates with said first connector; and (b) a service vehicle with a fourth jumper cable connector permanently wired into its electrical system, said fourth connector removably mating with the remaining one of said second and third connectors.

3. A system as in claim 1, wherein:

(a) said engine is adapted to run continuously for periods up to six months.

4. A batteryless starting and ignition system for a conventional automotive-type internal combustion engine, said engine including an electrical system with an electric starter, alternator and voltage regulator, said system comprising:

(a) a battery replacement circuit which replaces and simulates the closed circuit effects of a typical automotive battery in said electrical system; and (b) means for starting said engine via an removable external electrical power supply; whereby (c) said engine will run continuously after said external power supply is removed.

5. A system as in claim 4, wherein:

(a) said battery replacement circuit comprises a capacitor.

6. A system as in claim 4, wherein:

(a) said battery replacement circuit comprises a resistance element placed in series with said capacitor via a first diode of a first polarity.

7. A system as in claim 6, wherein:

(a) said battery replacement circuit comprises a second diode placed in parallel with said resistance element and said first diode, said second diode having a polarity opposite from said first polarity.

8. A system as in claim 4, wherein:

(a) said means for starting comprises a first jumper cable connector, said connector being placed in parallel with said battery replacement circuit, and a start switch.

9. A system as in claim 8, and further comprising:

(a) a jumper cable with second and third connectors at opposite ends, at least one of which removably mates with said first connector; and (b) a service vehicle with a fourth jumper cable connector permanently wired into its electrical system, said fourth connector removably mating with the remaining one of said second and third connectors.

10. A system as in claim 9, wherein:

(a) said engine is adapted to drive an irrigation pumping station continuously for periods up to six months.

11. A method of starting and running an irrigation pumping station, said pumping station being driven by a conventional automotive internal combustion engine including an electrical system with an electric starter, alternator and voltage regulator, said method including the steps of:

(a) providing a battery replacement circuit which is connected into said electrical system in a position which would be typically occupied by an automotive battery;

(b) starting said engine from an external electrical source; and (c) removing said external electrical source, leaving said engine running.

12. A method as in claim 11, wherein said replacement circuit includes a jumper cable connector connected in parallel thereto, said starting step including the steps of:

(a) connecting a service vehicle battery to said jumper cable connector via a jumper cable;

(b) applying current from said battery to the starter of said engine.

13. A method as in claim 11, wherein said removing step includes the step of:

(a) disconnecting said jumper cable from said connector.

* * * * *